US005421428A

United States Patent [19]

Ingles

[11] Patent Number: 5,421,428

[45] Date of Patent: Jun. 6, 1995

[54] LADDER GUARD

[76] Inventor: Jack G. Ingles, 5120 #A Hwy. 212, Chaska, Minn. 55318

[21] Appl. No.: 143,612

[22] Filed: Nov. 1, 1993

[51] Int. Cl.[6] ..... E06C 5/32

[52] U.S. Cl. ..... 182/106; 182/230; 182/129

[58] Field of Search ..... 182/106, 129, 230; 248/231.4, 211, 552

[56] References Cited

U.S. PATENT DOCUMENTS

| | | | |
|---|---|---|---|
| 2,530,478 | 11/1950 | Parent | 248/231.4 X |
| 2,880,829 | 4/1959 | Watkins | 189/32 |
| 3,225,863 | 12/1965 | Ludlow | 182/104 |
| 3,240,455 | 3/1966 | Swezy | 248/231.4 X |
| 3,311,195 | 3/1967 | Singer | 182/230 |
| 3,372,772 | 3/1968 | Singer | 182/230 |
| 3,698,798 | 10/1972 | Bolton | 248/231.4 X |
| 3,790,117 | 2/1974 | Winkler | 248/231.4 X |
| 3,968,857 | 7/1976 | Bryan | 182/106 |
| 4,039,129 | 8/1977 | Berkeland | 248/211 X |
| 4,126,206 | 11/1978 | Becnel | 182/129 |
| 4,181,195 | 1/1980 | Clarke | 182/230 |
| 4,450,937 | 5/1984 | Broughton | 182/206 |
| 4,473,176 | 9/1984 | Harper | 248/552 X |
| 4,579,197 | 4/1986 | Spurling | 182/106 |
| 4,658,607 | 4/1987 | Muse | 248/552 X |
| 5,222,132 | 6/1993 | Rioux | 248/231.4 X |

*Primary Examiner*—Alvin C. Chin Shue
*Attorney, Agent, or Firm*—Rick Martin

[57] ABSTRACT

The invention is a ladder guard which prevents unauthorized access to a ladder. Preventing injury to children is a primary goal of the invention. The ladder guard has a top and a bottom hook extending from two metal sheets. The hooks can be adjusted to go between two to four ladder rungs, thus preventing use of the covered rungs. The top and bottom hooks are adjustable to fit any size rungs. The metal sheets may be locked to prevent removal. A tool tray is also mountable when the ladder is in use. The invention works with all known ladders. It is, therefore, a removable universal fitting ladder guard.

10 Claims, 3 Drawing Sheets

LADDER GUARD

FIELD OF INVENTION

The present invention relates to ladder locking devices for ladders on motor homes, campers, vans, boats, construction sites, in schools, storage tanks, television and radio towers, tall buildings, silos, swimming pools, and other locations.

BACKGROUND OF THE INVENTION

It is often desirable to be able to prevent climbing access to ladders. This is especially true where ladders present an attractive nuisance to children, and where ladders provide ready access to vehicles, buildings, or towers. A child can be injured while climbing any ladder. There is a need for some type of ladder guard for preventing unauthorized use of ladders. The prior art includes several ladder guards.

In U.S. Pat. No. 2,880,829 (1959) Watkins discloses a shield used to cover the horizontal cross bars of a triangular tower. The triangular shield is self supported by a hook on its upper end that slips over a horizontal cross bar, thus suspending the device over a number of cross bars to effectively prevent ascension of the tower. Watkins' shield is only suited to triangular towers.

In U.S. Pat. No. 3,225,863 Ludlow (1965) discloses a hinged attachment to be affixed to a ladder to prevent the unauthorized use of the ladder. This device consists of a smooth panel covering several horizontal cross bars of a ladder which is side hinged to swing out allowing use of the ladder. Ludlow's construction is much more elaborate than the present invention and must be permanently installed.

In U.S. Pat. No. 3,311,195 Singer (1967) discloses a ladder guard designed primarily for use with above ground swimming pools. This is a safety device consisting of a flat panel covering several ladder steps to prevent small children from climbing up the ladder into the pool area. The Singer ladder lock employs hooks in a manner similar to the present invention, but does not allow for locking, and thus may be easily removed by children and others. The Singer device also is not adaptable for different sized ladders.

In U.S. Pat. No. 3,372,772 Singer (1968) discloses a device similar to his first but with the additional feature of a self-latching support mechanism which latches via a spring loaded tongue to the underside of the horizontal cross bars of the ladder. Singer's device is not adjustable and may be removed by anyone by merely pushing the spring-loaded tongues.

In U.S. Pat. No. 3,968,857 (1976) Bryan discloses a safety shield and support mechanism that can be attached to any type of ladder with horizontal cross members. The device consists of a support mechanism attached to the cross bars of the ladder. The support mechanism is bolted to the cross bars and thus is designed to be permanently affixed. A flat shield is locked onto the support mechanism. The flat shield covers several cross bars of the ladder to prevent ascension. Bryan's shield is very elaborate and must be permanently bolted to the ladder.

In U.S. Pat. No. 4,126,206 (1978) Becnel discloses a ladder guard consisting of two flat plates which are hinged together at the mid-point. The upper plate has a hook which slips over a horizontal cross bar of the ladder. The hinge allows the plates to be pulled outward from the ladder and to slip the lower plate between two cross bars and behind the ladder. This allows access to a locking device from the front of the ladder. Becnel's guard must be custom manufactured to fit a particular ladder.

In U.S. Pat. No. 4,181,195 (1980) Clarke discloses a ladder guard for use with recreational vehicles. The device consists of a flat panel that slips over an upper cross bar of the ladder and is suspended over the lower cross bars. The invention discloses a keyed locking mechanism that secures the ladder guard to a lower cross bar on the ladder. Clarke's guard is not adjustable and will not fit right for ladders with different rung spacing. The Clarke ladder lock also is not adaptable to different sized ladders, and few stores can afford the space to effectively display such a huge device.

In U.S. Pat. No. 4,450,937 (1984) Broughton discloses a step ladder with a flat panel on one side. This device can be attached, with the flat panel facing outward, to an existing ladder such as those found on recreational vehicles. The flat panel prevents the ascension of the ladder in order to prevent the theft of items stored on top of the recreational vehicle. The ladder can also be removed to provide a separate step ladder. Broughton's step ladder addresses a different need than the present invention.

In U.S. Pat. No. 4,579,197 (1986) Spurling discloses a safety device for use with above ground swimming pools. The flat shield is gravity supported at the base of the ladder. It rests up against the ladder and is secured by a locking bar that slips through two holes in the sides of the shield and behind the ladder. Spurling's device will not accommodate wide or narrow ladders. It also must rest on the ground and thus will not work on mobile ladders.

In summary the present invention solves two problems. First it is no longer necessary to custom fit a ladder guard to a particular ladder. Second it is no longer necessary to permanently mount a ladder guard to a particular ladder. The present invention is both portable and universally adaptable to all ladders.

SUMMARY OF THE INVENTION

The primary object of the present invention is to prevent unauthorized ladder use.

Another object of the present invention is to accommodate any ladder rung size and shape.

Another object of the present invention is to accommodate any ladder rung spacing.

Another object of the present invention is to provide simple construction for ease of manufacturing.

Another object of the present invention is to provide for ease of installation, removal, and use.

Another object of the present invention is to provide for portability.

Another object of the present invention is to provide for easy locking and unlocking.

Another object of the present invention is to allow use with a standard padlock.

Another object of the present invention is to provide a tool tray for use with a ladder.

Other objects of this present invention will appear from the following description and appended claims, reference being had to the accompanying drawings forming a part of this specification wherein like reference characters designate corresponding parts in the several views.

The present invention is preferably made of two metal sheets bolted together. Each sheet has a hook assembly meant to wrap around a ladder rung. The two hook assemblies engage the top and bottom rungs to be covered. To attach to a ladder, the user first hooks the top of the ladder guard over the top rung to be protected, then loosens the nuts, thereby lowering the bottom sheet. The user then raises the bottom sheet to the point where the lower hook assembly engages the lower rung to be protected, then tightens the nuts. A standard padlock can then be used to lock the ladder guard in place.

A tool tray may also be mounted. In this arrangement the device serves as a holder for construction tools, paint or the like. The tool tray has a pair of a projecting bolts which easily fasten into slots in the sheets.

The hook assemblies can be constructed in two ways. In the first method, each sheet has a distal tongue, which is bent in the shape of a hook. The entire device then consists of only two metal sheets bent to shape, and connecting bolts.

In the second method, the two main sheets each have a distal tongue bent substantially perpendicular. An angled plate is bolted to the tongue, forming the hook assembly. The angle plates can be adjusted closer to or farther away from the main sheets. In this way any ladder may be accommodated.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE PREFERRED EMBODIMENT

Figure 1:
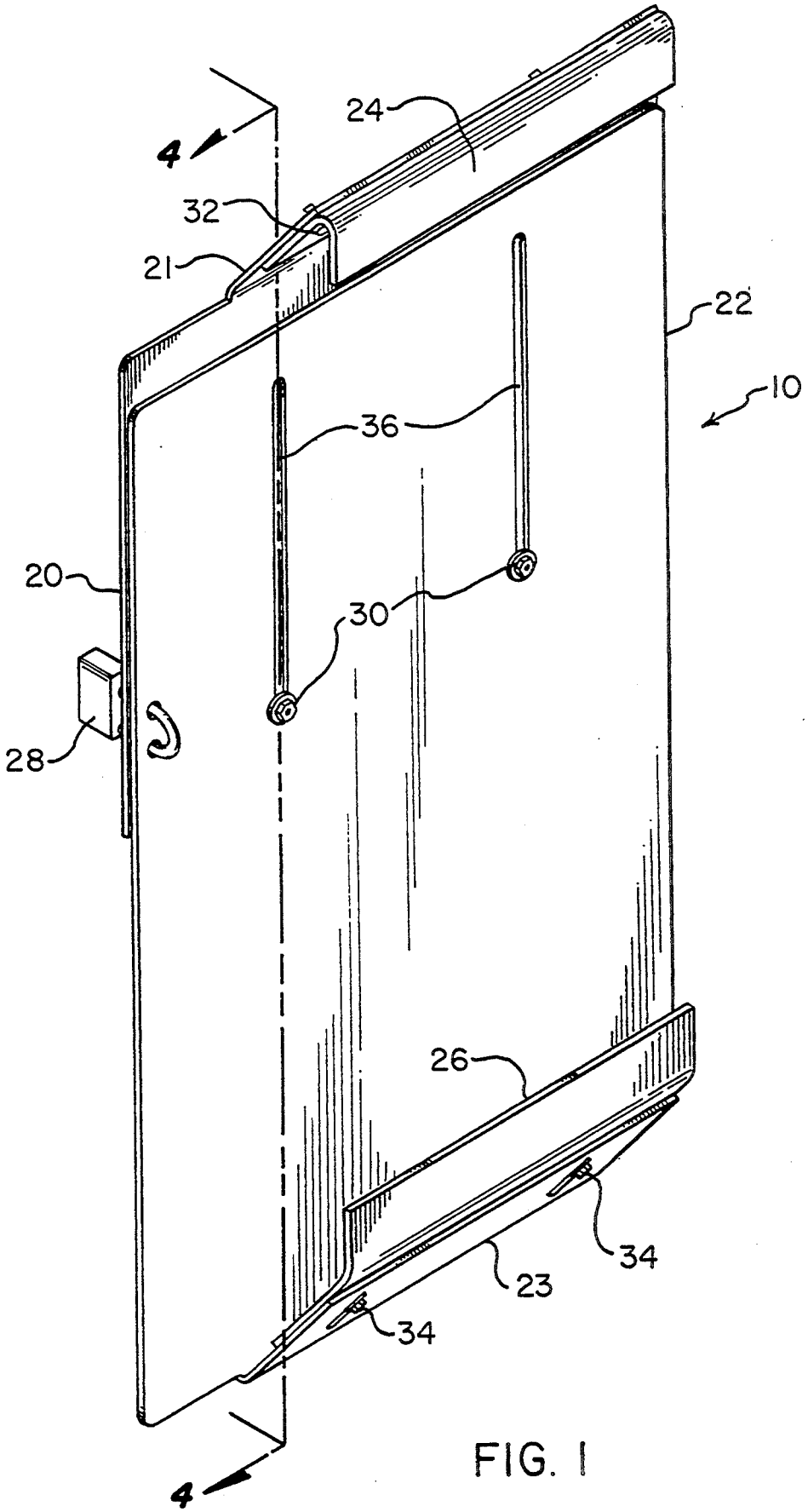
FIG. 1 is a perspective view of the ladder guard.

Referring first to FIG. 1 a perspective view of the ladder guard 10 is shown. The ladder guard is extendible and may be mounted to as few as two or as many as four ladder rungs. In operation the ladder guard 10 prevents a would-be ladder climber from placing a foot on all but the top rung covered by the ladder guard 10. This has been found to be effective at preventing ladder use.

The ladder guard 10 is constructed of a metal top sheet 20 and a bottom sheet 22. The sheets are fastened with two connecting bolts 30. The bottom sheet 22 is configured with sheet slots 36 which allow the sheets to extend to span many rungs or to contract to span few rungs, depending on the needs of the user. The connecting bolts 30 are preferably carriage bolts, which have a square cross section near the non-threaded end. This square cross section then fits into a square hole in the top sheet 20. The connecting bolts 30 include normal hexagon shaped nuts or wing nuts. If wing nuts are used, the bolt ends are preferably ground or bent so that the wing nuts cannot be removed. Washers are also employed.

The top and bottom of the ladder guard 12 end in hook assemblies. In the preferred embodiment each hook assembly is adjustable so as to accommodate any ladder. The top sheet 20 includes the top tongue 21 and attaches to the top angled plate 24. The bottom sheet 22 includes the bottom tongue 23 and attaches to the bottom angled plate 26.

When the ladder guard 10 is attached to the ladder, a padlock 28 may be used to prevent removal. The padlock 28 prevents the top sheet 20 from moving relative to the bottom sheet 22. The padlock 28 is mounted through aligned holes in the top sheet 20 and the bottom sheet 22. The holes may be drilled during manufacture or by the user. One pair of padlock holes work, but two are preferred. If the two connecting bolts 30 are removed by a would-be ladder climber, two padlock holes provide more security. The padlock holes must be placed near the edge; otherwise the padlock could not be fastened.

An alternate embodiment (not shown) eliminates top angled plate 24 and bottom angled plate 26. Top tongue 21 and bottom tongue 23 are then shaped like a "U" or a "V" so as to hook onto rungs. While this alternate embodiment may not be as versatile, it is less expensive. Custom versions may be made for specific types of ladders, like those found on vans and motor homes.

Another alternate embodiment (not shown) employs lateral tabs on the top sheet 20, wrapping around the bottom sheet 22. This allows the two sheets to slide up and down but not to be tightened. A padlock is used to lock the ladder guard as with the preferred embodiment. This use of side tabs is conventional.

Figure 2:
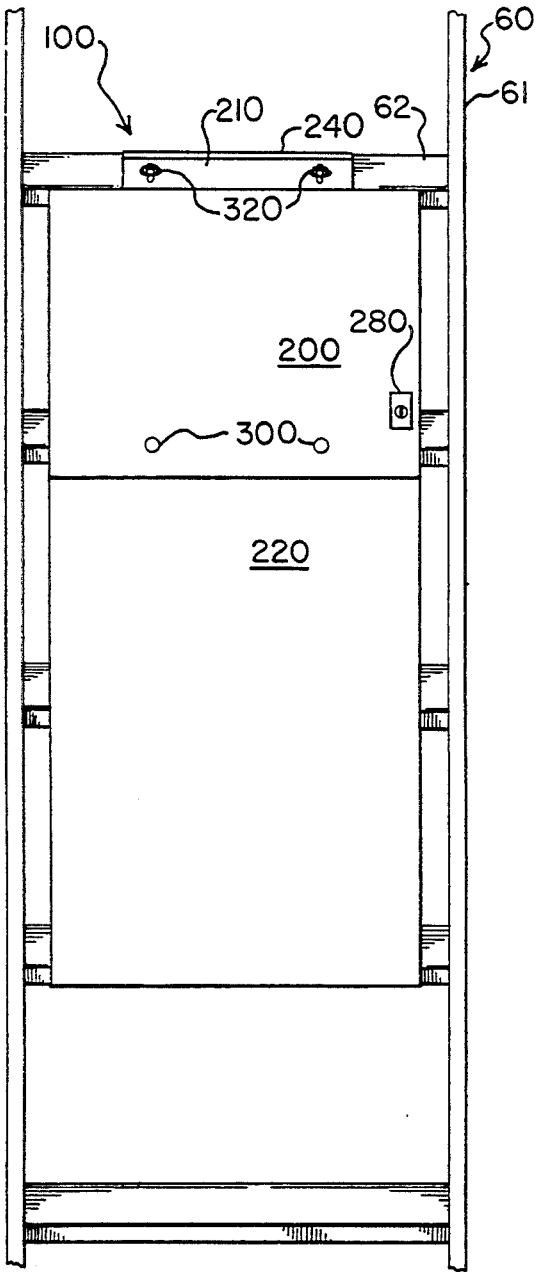
FIG. 2 is a front view of the ladder guard mounted on a wide ladder.

Referring next to FIG. 2 the ladder guard 10 is shown mounted on a wide ladder 60. The ladder guard 10 fits between the side rails 61 of the wide ladder 60 while still preventing use.

Most ladders are no wider than 13 inches between the outside of the side rails. The ladder guard 100 is preferably 13 inches wide. Some older wooden ladders are as wide as 16 inches, but only at the base, which is lower than the ladder guard would normally be mounted. In testing the device, the inventor has found that children were unable to ascend a ladder with as much as one inch of rung space. Thus even the widest ladders in common use cannot be ascended with the ladder guard 100 installed.

Figure 3:
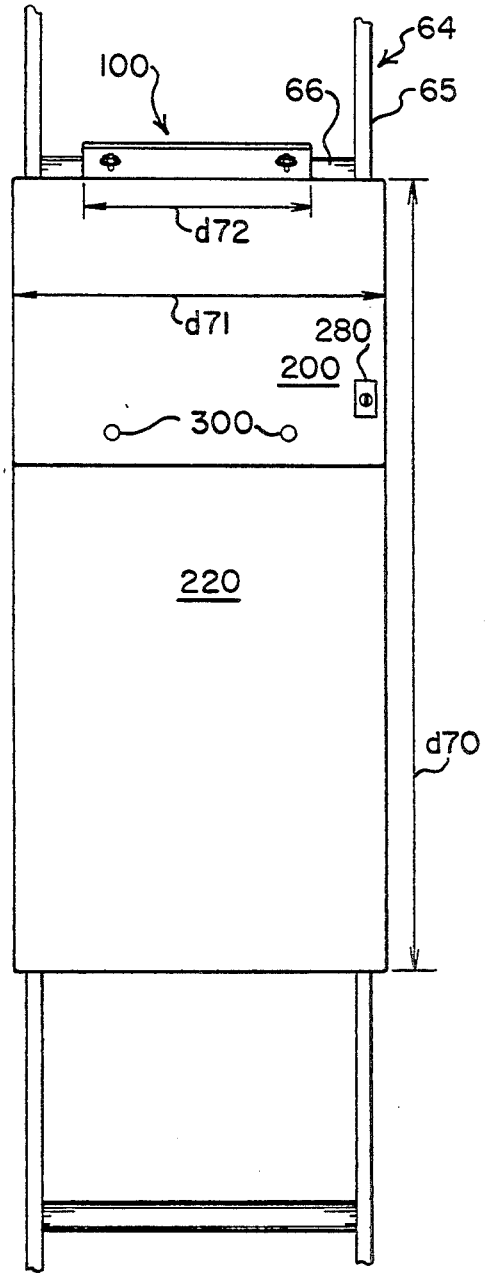
FIG. 3 is a front view of the ladder guard mounted on a narrow ladder.

Referring next to FIG. 3 the ladder guard 100 is shown mounted on the narrow ladder 64. The ladder guard 100 completely overlaps the side rails 65 of the narrow ladder 64, thereby preventing ascension. The preferable sheet width d71 of the ladder guard 10 is 13 inches. Most recreational vehicles have a ladder width of 13 inches. The preferable tongue width d72 is 8 inches. This allows the ladder guard to fit ladders with inside rails as narrow as 8 inches. The length d70 ranges from 22 inches to 29 inches when fully extended.

Figure 4:
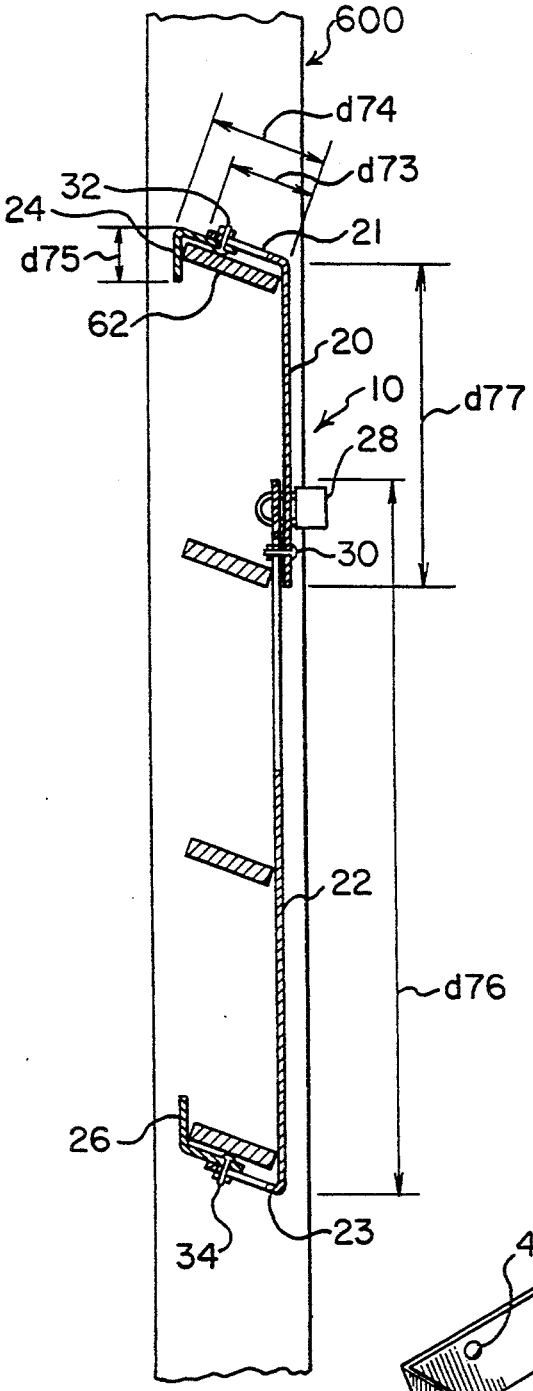
FIG. 4 is a cross-sectional side view of the ladder guard mounted on a wide ladder viewed from 4—4 on FIG. 1.

Referring next to FIG. 4 a cross-sectional side view of the ladder guard 10 is shown. Top angled plate 24 and bottom angled plate 26 engage the rungs 620 of wide ladder 600. The padlock 28 prevents removal of the ladder guard 10. Dimensions are detailed in Table 1.

The top sheet 20 has a top tongue 21 that extends inward and is bent 70 degrees to form a 110 degree angle. The top angled plate 24 is bent 110 degrees to form a 70 degree angle. The most distal plane of the top angled plate 24 is therefore parallel with the plane of the top sheet 20 and the bottom sheet 22. The top angled plate 24 is attached to the top tongue 21 with two top hook bolts 32. Slots permit adjustment for wider or narrower rungs.

The bottom sheet 22 has a bottom tongue 23 that extends inward and is bent 110 degrees to form a 70 degree angle. The bottom angled plate 26 is bent 70 degrees to form a 110 degree angle. The most distal plane of the bottom angled plate 26 is therefore parallel with the plane of the top sheet 20 and the bottom sheet 22. The bottom angled plate 26 is attached to the bottom tongue 23 with two bottom hook bolts 34. Slots permit adjustment for wider or narrower rungs.

The 70 degree and 110 degree angles in the hook assemblies are formed so that the ladder guard 10 fits well on standard ladders, which are meant to be used at a 70 degree angle and have rungs angled at 70 degrees.

This angled construction ensures a good fit on the rungs of most ladders, and also works well on ladders with round rungs. The top hook bolts 32 and bottom hook bolts 34 further act to prevent lateral motion when in place by digging in to the surface of the engaged rungs.

Figure 5:
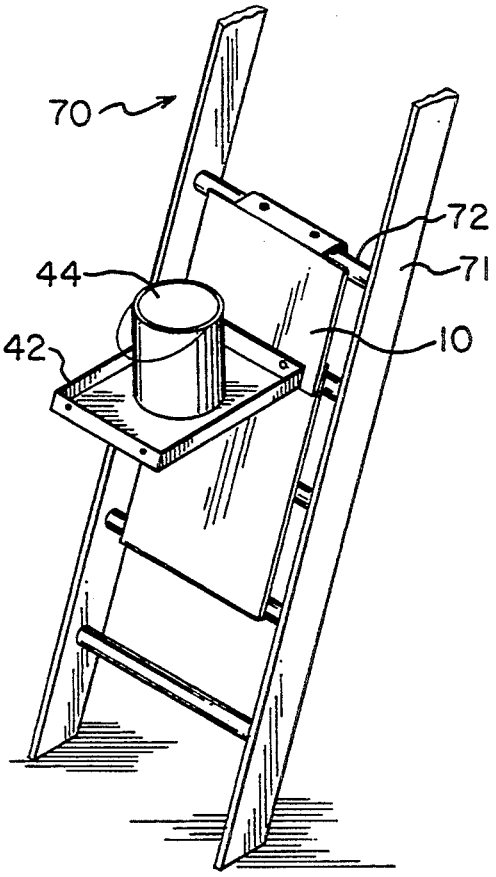
FIG. 5 is a perspective view of the ladder guard with the tool tray in operation.

Referring next to FIG. 5 an alternate use of the ladder guard 10 with tool tray 42 is shown. The tool tray 42 supports paint can 44, and can accommodate other construction tools. The ladder guard 10 is not meant to be locked in place while being used for holding tools. Only the top hook assembly needs to engage a ladder rung. The ladder guard works well as a tool tray holder without gripping the bottom rung.

The tool tray 42 can be mounted on the front side of the ladder guard 10 as shown, or alternatively mounted on the back side (not shown) depending on the needs of the user.

Figure 6:
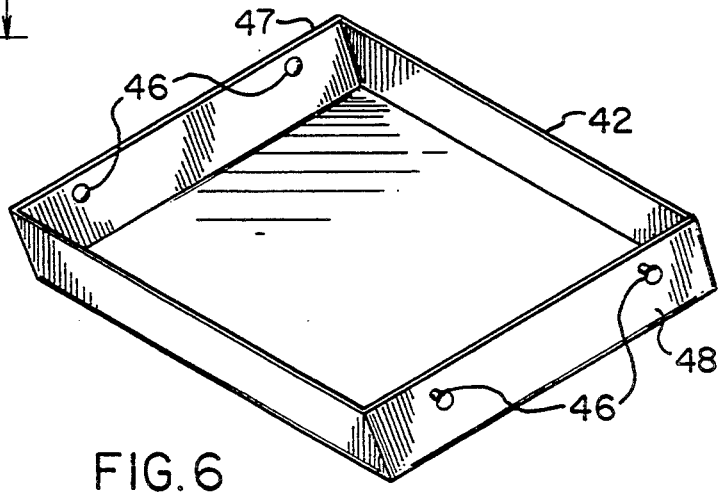
FIG. 6 is a perspective view of the tool tray.

Referring next to FIG. 6 details of the tool tray are shown. The tool tray 42 is attached to the ladder guard 10 with mounting bolts 46, which fit into key shaped slots (not shown) in the top sheet 20 or the bottom sheet 22. The mounting bolts 46 are not meant to be tightened in use, and may be rivets. This construction is a well known means of fastening objects. Alternatively connecting bolts 30 could be used to mount the tool tray 42.

The front angled mounting plate 47 allows for the tool tray 42 to remain level for use on a standard angled ladder. Most ladders are angled 70 degrees while in use. The tool tray 42 may be mounted on the back side of the top sheet 20 and the bottom sheet 22, in which the back angled mounting plate 48 is used instead of the front angled mounting plate 47.

Although the present invention has been described with reference to preferred embodiments, numerous modifications and variations can be made and still the result will come within the scope of the invention. No limitation with respect to the specific embodiments disclosed herein is intended or should be inferred.

Table 1—Ladder Guard Dimensions d70—working length—varies from 22 inches to 29 inches
d71—sheet width—13 inches
d72—tongue width—8 inches
d73—tongue length—2.5 inches
d74—proximal angled plate length—2.0 inches
d75—distal angled plate length—1.5 inches

I claim:

1. A ladder guard to prevent persons from climbing a ladder having a plurality of rungs, said ladder having an outside used for climbing and an inside facing the structure climbed, comprising:

a top sheet having a tongue extending upward and bent inward to form a top hook for an upper rung;

a bottom sheet having a lower edge which further comprises a tongue extending upward and bent inward to form a bottom hook for a lower rung;

a top and bottom sheet attachment means, wherein said sheets are slidably engaged against one another whereby said attachment means can be secured allowing said top hook and said bottom hook to securely engage the upper and lower rungs of said ladder, preventing climbing of said ladder;

fastening means on said top sheet and on said bottom sheet; and a tool tray attached to said fastening means.

2. The ladder guard of claim 1 wherein said slidable top and bottom attachment means further comprises a slot in said top sheet and said bottom sheet and a connecting bolt therebetween.

3. The ladder guard of claim 1, wherein said top and bottom sheets further comprise locking means to prevent removal of said ladder guard from said ladder.

4. The ladder guard of claim 3 wherein said locking means further comprises a hole in said top sheet, a hole in said bottom sheet, and a padlock therebetween.

5. The ladder guard of claim 1 wherein:

said top hook further comprises an angled plate slidably fastened to said tongue of said top sheet; and said bottom hook further comprises an angled plate slidably fastened to said tongue of said bottom sheet.

6. A ladder guard for a ladder, comprising:

said ladder having a vertically arranged plurality of horizontal rungs, and having an outer climbing side and an inner side;

a first rung blocking panel;

a second rung blocking panel;

vertical positioning means between said first and second rung blocking panels;

said vertical positioning means further comprising fastening means;

said first rung blocking panel further comprising an upper tongue which forms a hook means for an upper rung;

a lower edge of said second rung blocking panel further comprising a lower tongue which forms a hook means for a lower rung, whereby hooking said first hook means to an upper rung and hooking said second hook means to a lower rung and securing the fastening means affixes the ladder guard on the ladder, functioning to prevent climbing the ladder by blocking access to at least the lower rung; and a tool tray, functioning to hold tools for a ladder user, removably attached to said ladder guard.

7. The ladder guard of claim 6, wherein said vertical positioning means further comprises interlocking hole means.

8. The ladder guard of claim 7, wherein said interlocking hole means further comprises slots and rod means.

9. The ladder guard of claim 8, wherein said rod means further comprises a bolt and a nut, said bolt going through said slots, and said nut tightenably fastened to said bolt.

10.The ladder guard of claim 6, wherein said upper and lower tongue means each further comprise an angled plate slidably mounted thereto.

* * * * *